US008277609B2

(12) United States Patent
Hermans et al.

(10) Patent No.: US 8,277,609 B2
(45) Date of Patent: Oct. 2, 2012

(54) TISSUE MACHINE PARENT ROLL HAVING VARIABLE INTRINSIC SHEET DRYNESS

(75) Inventors: Michael Alan Hermans, Neenah, WI (US); Richard Louis Underhill, Neenah, WI (US); Kenneth John Zwick, Neenah, WI (US)

(73) Assignee: Kimberly-Clark Worldwide, Inc, Neenah, WI (US)

( * ) Notice: Subject to any disclaimer, the term of this patent is extended or adjusted under 35 U.S.C. 154(b) by 864 days.

(21) Appl. No.: 11/897,580

(22) Filed: Aug. 30, 2007

(65) Prior Publication Data

US 2009/0056894 A1 Mar. 5, 2009

(51) Int. Cl.
*B65H 18/28* (2006.01)
*B29D 22/00* (2006.01)

(52) U.S. Cl. ..... 162/118; 428/34.2; 242/160.1; 242/164; 242/176

(58) Field of Classification Search ..... 162/118–122, 162/201, 204–207; 428/34.1–34.3; 242/159, 242/160.1, 160.4, 164, 174–176
See application file for complete search history.

(56) References Cited

U.S. PATENT DOCUMENTS

| | | | | |
|---|---|---|---|---|
| 3,647,618 | A * | 3/1972 | Back et al. | 162/205 |
| 3,810,589 | A * | 5/1974 | Mousseau | 242/413 |
| 5,505,820 | A * | 4/1996 | Donigian et al. | 162/206 |
| 5,672,248 | A | 9/1997 | Wendt et al. | |
| 5,944,273 | A * | 8/1999 | Lin et al. | 242/160.4 |
| 6,098,510 | A * | 8/2000 | Hada et al. | 83/13 |
| 6,126,784 | A * | 10/2000 | Ficke et al. | 162/184 |
| 6,440,268 | B1 * | 8/2002 | Baggot et al. | 162/118 |
| 6,698,681 | B1 * | 3/2004 | Guy et al. | 242/534 |
| 6,733,608 | B1 * | 5/2004 | Baggot et al. | 156/157 |
| 7,442,279 | B2 * | 10/2008 | Hermans et al. | 162/118 |
| 7,484,686 | B2 * | 2/2009 | Seger et al. | 242/541.4 |
| 7,661,622 | B2 * | 2/2010 | Hada et al. | 242/535.4 |
| 7,666,276 | B2 * | 2/2010 | Hermans et al. | 162/283 |
| 2004/0099706 | A1 * | 5/2004 | Krautkramer et al. | 226/1 |
| 2005/0006043 | A1 * | 1/2005 | Vinson et al. | 162/181.1 |
| 2005/0156078 | A1 * | 7/2005 | Ragard et al. | 242/534 |
| 2006/0289692 | A1 * | 12/2006 | Horneck et al. | 242/535.4 |
| 2007/0075178 | A1 * | 4/2007 | Hada et al. | 242/539 |
| 2007/0102127 | A1 * | 5/2007 | Hermans et al. | 162/118 |
| 2008/0017748 | A1 * | 1/2008 | Seger et al. | 242/541.4 |
| 2008/0264280 | A1 * | 10/2008 | Baggot et al. | 101/248 |
| 2008/0271863 | A1 * | 11/2008 | Zoller et al. | 162/109 |
| 2009/0056894 | A1 * | 3/2009 | Hermans et al. | 162/119 |
| 2009/0189008 | A1 * | 7/2009 | Gustavsson | 242/547 |
| 2009/0321027 | A1 * | 12/2009 | Hermans et al. | 162/111 |

OTHER PUBLICATIONS

TAPPI Classical Method T 210 cm-93, "Sampling and Testing Wood Pulp Shipments for Moisture," published by the TAPPI Press, Atlanta, Georgia, revised 1993, pp. 1-5.
TAPPI Official Test Method T 402 om-93, "Standard Conditioning and Testing Atmospheres for Paper, Board, Pulp Handsheets, and Related Products," published by the TAPPI Press, Atlanta, Georgia, revised 1993, pp. 1-3.
TAPPI Official Test Method T 411 om-89, "Thickness (Caliper) of Paper, Paperboard, and Combined Board," published by the TAPPI Press, Atlanta, Georgia, revised 1989, pp. 1-3.
Amiri, R. et al., "Moisture Distribution in Paper Rolls: The Effect of Wrapping Materials," Journal of Pulp and Paper Science, vol. 28, No. 5, May 2002, pp. 143-150.

* cited by examiner

*Primary Examiner* — Jose A Fortuna
(74) *Attorney, Agent, or Firm* — Michael J. Sullivan

(57) ABSTRACT

The intrinsic tissue sheet properties of tissue sheets wound into a parent roll during manufacturing can be purposely varied in order to provide a z-directional gradient within the parent roll. For example, the moisture content of the tissue sheet can be made lower in the core region of the parent roll and greater in the outer region of the parent roll. Such gradients can ultimately provide more uniformity of the intrinsic property within the final tissue product.

5 Claims, 7 Drawing Sheets

TISSUE MACHINE PARENT ROLL HAVING VARIABLE INTRINSIC SHEET DRYNESS

BACKGROUND OF THE INVENTION

In the manufacture of tissue products, such as facial tissue, bath tissue, paper towels and the like, the dried tissue web leaving the tissue machine is wound up into a large roll called a "parent roll". These parent rolls are typically about 90-140 inches in diameter and 100-110 inches wide. Parent rolls are transported to a converting facility within the tissue mill where they are unwound and converted into the desired final product form. Among the various converting operations, fixed-load calendering of the unwound sheet to soften the sheet and control caliper (bulk) is commonly used.

In order to properly wind the dried tissue web into a parent roll, in some high-bulk processes, the tissue web is commonly over-dried to a moisture level of about 0.5-1.5 weight percent. If higher moisture levels are obtained, product quality issues can arise because of a loss of caliper in the parent roll and roll slippage during winding. Roll slippage often creates a roll that cannot be properly unwound in downstream operations.

On the other hand, producing a parent roll with a constant moisture level throughout the parent roll of about 0.5-1.5 weight percent requires more drying energy than is necessary for the final product because the dried sheet ultimately equilibrates to a moisture content of about 5 weight percent by the time it reaches the consumer. In addition, when the parent roll is formed, the wound-in pressure within the roll is inherently greater in the center of the roll than at the outer segments of the roll. This results in a reduced sheet caliper near the center of the roll as compared to the sheet caliper near the outer segments of the roll. This sheet caliper variation creates problems in the downstream converting/calendering operation because it results in sheet caliper variations in the final product.

Therefore, there is a need for a method for improving the caliper uniformity of calendered tissue sheets and for improving the energy efficiency of the tissue manufacturing process. This is particularly important for high-bulk, through-air-dried processes, where the web is often calendered to improve softness.

SUMMARY OF THE INVENTION

It has now been discovered that a parent roll can be manufactured with a purposely induced z-direction moisture profile such that the segment of the sheet within the core region of the parent roll has a relatively low moisture content (about 0.5-1.5 weight percent) and the segment of the sheet in the outer region of the parent roll has a relatively high moisture content (about 2-3 weight percent). Because increased moisture content reduces the ability of a tissue sheet to resist compression, a segment of the sheet in the outer region of the parent roll having a moisture content of 2-3 weight percent will have a lower caliper (bulk) than the same sheet segment would have had if the moisture content were about 0.5-1.5 weight percent. Since the portions of the sheet in the outer region of the parent roll experience less wound-in pressure than the portions of the sheet in the core region of the parent roll, the caliper of the sheet throughout the z-direction of the parent roll can be equalized, or at least made more uniform, by balancing the level of wound-in pressure with the moisture content. In other words, as the amount of wound-in pressure within the parent roll decreases, the amount of moisture can correspondingly be increased to achieve more uniform sheet caliper within the parent roll. This translates into more uniform sheet caliper for the final tissue product as well, which is a benefit from a product quality standpoint. In addition, by retaining a higher level of moisture in the segment or portions of the sheet residing in the outer region of the parent roll as a result of less dewatering or drying as will be described herein, an energy cost savings can also be realized.

Hence in one aspect, the invention resides in a parent roll having purposely or intentionally induced z-directional intrinsic sheet property differences. While an intrinsic sheet property of particular interest is sheet moisture, other intrinsic sheet properties can also be purposely adjusted to provide sheet property variations within the parent roll, such as basis weight, sheet caliper and geometric mean tensile strength. More specifically, the z-directional intrinsic sheet property differences can create a gradient within the parent roll, wherein the average intrinsic sheet property of a segment or portion of the sheet in the core region of the parent roll is different than the average intrinsic sheet property of a segment or portion of the sheet in the outer region of the parent roll. Those skilled in the tissue making arts will appreciate that for purposes herein, average intrinsic sheet property values are representative of large lengths of the wound basesheet due to the large amount of sheet material in a parent roll. By way of example, a parent roll can have as much as 50,000 yards of a continuous wound tissue sheet. Therefore any purposely induced z-directional intrinsic sheet property differences will be readily detectable by measuring representative portions of the wound sheet within different regions of the parent roll.

In another aspect, the invention resides in a method of making multiple parent rolls of tissue on a tissue machine wherein at least one manufacturing operation is cyclically varied in time on the tissue machine such that purposely induced z-directional intrinsic sheet property differences are created in successive parent rolls.

For purposes herein, a purposely induced z-directional sheet property difference is a significant variation from the sheet property values normally encountered during commercial manufacturing operations at a particular position within the parent roll. Such significant variations can be about 25 percent or greater, about 35 percent or greater, about 50 percent or greater, about 100 percent or greater, about 200 percent or greater, about 300 percent or greater, about 400 percent or greater, or about 500 percent or greater. Furthermore, the sheet property differences can be in the form of a gradient which, for purposes herein, represents an increasing z-directional intrinsic sheet property value or a decreasing z-directional intrinsic sheet property value as a function of the diameter of the parent roll, and more specifically between the core region and the outer region of the parent roll. The gradient can be continual (constantly changing) or it can be a step change (abruptly changing from one value to another) or a series of step changes. The nature of the gradient will depend on the manufacturing operation being manipulated to alter the intrinsic sheet property within the parent roll and the precision with which the manufacturing operation can varied.

For sheet moisture, as previously mentioned, it is ideal to achieve a moisture gradient that follows and compensates for variations in the wound-in pressure within the parent roll in order to attain or approach a constant parent roll sheet caliper. In practice, benefits from this invention can be obtained even if the actual z-directional sheet property gradient is only an approximation of the ideal gradient. For example, the average sheet moisture in the core region of the parent roll can be from about 0.5 to about 1.5 percent, more specifically from about 0.5 to about 1 percent, or from about 1 to about 1.5 percent. At the same time, the average sheet moisture in the outer region of the parent roll can be from about 2 to about 5 percent, more specifically from about 2 to about 4 percent, more specifically from about 2 to about 3 percent, or from about 3 to about 5 percent, or from about 3 to about 4 percent.

For purposes herein, "sheet moisture" is the average sheet moisture for a 10 foot sheet segment within the parent roll. Moisture level is determined by weighing the moisture-containing sheet and comparing the weight of this sheet to the weight of the sheet after drying the sheet in an oven until the moisture has been removed. A suitable test method for determining sheet moisture is described in TAPPI Test T-210 cm-93.

To provide a moisture gradient in parent rolls in accordance with this invention, several common manufacturing operations can be varied. For example, the tissue web entering the dryer can be provided with different levels of moisture by turning off one or more vacuum pumps used to dewater the web on the wet end of the tissue machine. Reducing the vacuum will increase the level of moisture in the wet web. Under a constant drying energy level, this increased web moisture will pass through to the dried sheet in the parent roll. In a continuous process, raising and lowering the vacuum can be cycled and timed to provide the desired moisture gradient in the resulting parent roll. The vacuum level can continuously be varied or it can be altered between "on" and "off", depending on the nature of the gradient desired.

Another manufacturing operation that can be used to alter the moisture content is to selectively subject the dried tissue sheet to additional drying, such as by infra-red heating. In this manner, the tissue machine dryer can be set to produce a higher than normal level of retained moisture in the sheet, such as about 2-3 weight percent. The infra-red post-heating of the sheet can then be used to selectively lower the moisture in segments of the sheet to provide the desired parent roll gradient. Again, the infra-red post-heating can be cycled and timed to produce the desired moisture profile or gradient in successive parent rolls.

Additional methods for altering the sheet moisture include varying the throughdryer gas flow and/or air flow. Increasing the throughdryer gas flow will reduce sheet moisture, as will increasing the air flow. Conversely, these parameters can be reduced when an increase in sheet moisture is desired. In a tissue machine having two throughdryers, either throughdryer can be adjusted, depending on the desired result and the specifics of the machine configuration. In addition, other methods such as adjusting the amount of water used for cleaning the fabrics can be used to adjust final moisture. For example, putting additional water on the fabrics for cleaning purposes may increase the final sheet moisture, so this procedure can be utilized during periods when high moisture is desired, and the cleaning water turned off when the low moisture is desired.

A caliper gradient in the parent roll can be developed by varying the vacuum level used for transferring the wet web to the throughdrying fabric. Higher levels of vacuum will conform the web more tightly to the contours of the throughdrying fabric, resulting in greater sheet caliper. Lower vacuum levels will result in lower sheet caliper. Alternatively, the moisture content of the sheet prior to molding could be varied. A higher pre-molding moisture content results in a higher caliper. For example, if one were to manufacture a parent roll initially having a higher sheet caliper in the core region and a lower sheet caliper in the outer region, the initial higher core region caliper might offset the caliper loss that ordinarily occurs near the core of the parent roll due to creep during storage. In this manner, after storage, the sheet caliper in the core region would be lowered to a level close to or equal to the caliper in the outer region of the parent roll. This in turn would enable a more consistent post-calendering final tissue product caliper.

For purposes herein, "caliper" is the representative thickness of a single sheet measured in accordance with TAPPI test methods T402 "Standard Conditioning and Testing Atmosphere For Paper, Board, Pulp Handsheets and Related Products" and T411 om-89 "Thickness (caliper) of Paper, Paperboard, and Combined Board" with Note 3 for stacked sheets. The micrometer used for carrying out T411 om-89 is an Emveco 200-A Tissue Caliper Tester available from Emveco, Inc., Newberg, Oreg. The micrometer has a load of 2 kilo-Pascals, a pressure foot area of 2500 square millimeters, a pressure foot diameter of 56.42 millimeters, a dwell time of 3 seconds and a lowering rate of 0.8 millimeters per second.

To provide a geometric mean tensile strength gradient, a debonder can be sprayed onto the web during the manufacture of the parent roll core region material, for example. It could be advantageous to reduce the tensile strength in the core region of the roll because in some cases, calendering of the sheet from the core region of the parent roll is reduced (for caliper maintenance) and hence the tensile strength reduction as a result of calendering is also reduced. By lowering the tensile strength of the sheet in the core region, the sheet tensile strength for the calendered sheet can ultimately be made to be more uniform. Spraying debonder can be easily controlled, not only in terms of on-off, but also in terms of varying the add-on level to provide more precise control to meet the particular conditions.

As used herein, "geometric mean tensile strength" is the square root of the product of the machine direction tensile strength multiplied by the cross-machine direction tensile strength. The machine direction tensile strength is the peak load per 3 inches of sample width when a sample is pulled to rupture in the machine direction. Similarly, the cross-machine direction (CD) tensile strength is the peak load per 3 inches of sample width when a sample is pulled to rupture in the cross-machine direction. The procedure for measuring geometric mean tensile strength is as follows.

Samples for tensile strength testing are prepared by cutting a 3 inches (76.2 mm) wide by 5 inches (127 mm) long strip in either the machine direction (MD) or cross-machine direction (CD) orientation using a JDC Precision Sample Cutter (Thwing-Albert Instrument Company, Philadelphia, Pa., Model No. JDC 3-10, Serial No. 37333). The instrument used for measuring tensile strengths is an MTS Systems Sintech 11S, Serial No. 6233. The data acquisition software is MTS TestWorks® for Windows Ver. 3.10 (MTS Systems Corp., Research Triangle Park, N.C.). The load cell is selected from either a 50 Newton or 100 Newton maximum, depending on the strength of the sample being tested, such that the majority of peak load values fall between 10-90% of the load cell's full scale value. The gauge length between jaws is 4+/−0.04 inches (101.6+/−1 mm). The jaws are operated using pneumatic-action and are rubber coated. The minimum grip face width is 3 inches (76.2 mm), and the approximate height of a jaw is 0.5 inches (12.7 mm). The crosshead speed is 10+/−0.4 inches/min (254+/−1 mm/min), and the break sensitivity is set at 65%. The sample is placed in the jaws of the instrument, centered both vertically and horizontally. The test is then started and ends when the specimen breaks. The peak load is recorded as either the "MD tensile strength" or the "CD tensile strength" of the specimen depending on direction of the sample being tested. At least six (6) representative specimens are tested for each product or sheet, taken "as is", and the arithmetic average of all individual specimen tests is either the MD or CD tensile strength for the product or sheet.

In the interests of brevity and conciseness, any ranges of values set forth in this specification are to be construed as written description support for claims reciting any sub-ranges having endpoints which are whole number values within the specified range in question. By way of a hypothetical illustrative example, a disclosure in this specification of a range of from 1 to 5 shall be considered to support claims to any of the following sub-ranges: 1-4; 1-3; 1-2; 2-5; 2-4; 2-3; 3-5; 3-4; and 4-5.

DETAILED DESCRIPTION OF THE DRAWINGS

Figure 1:
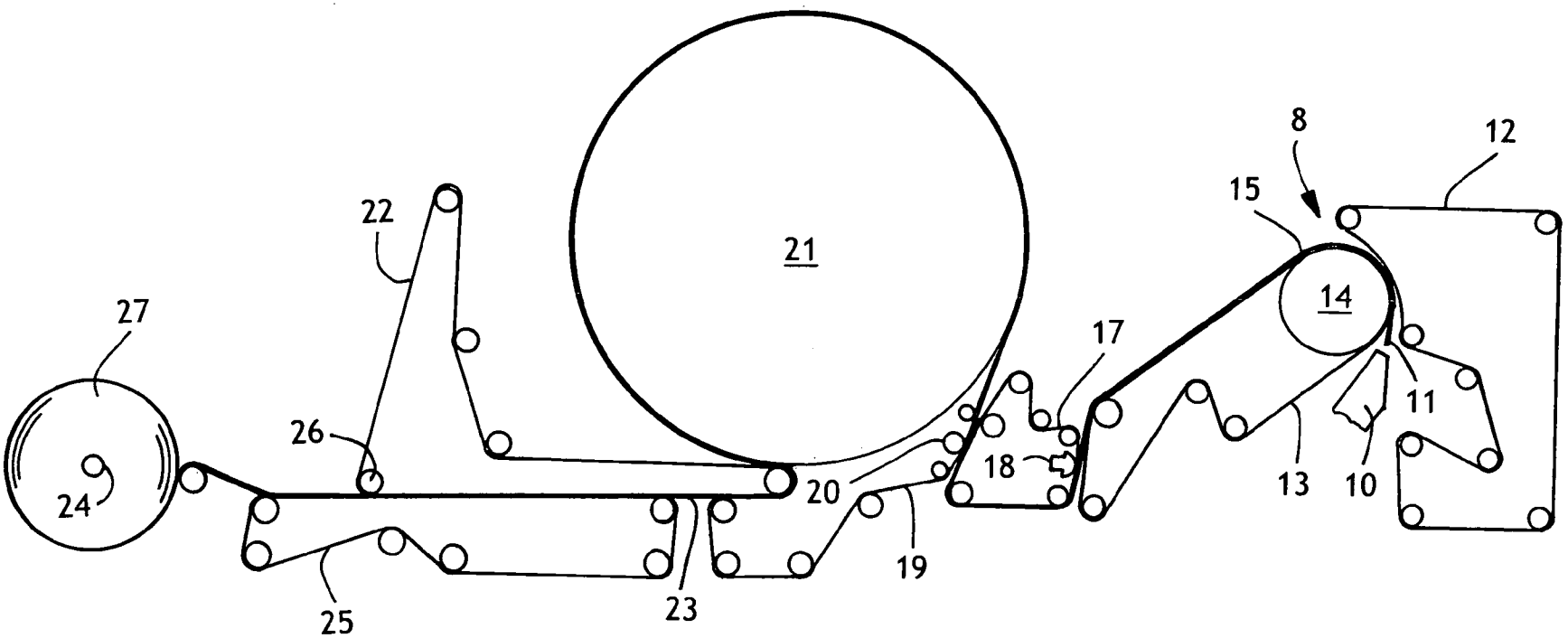
FIG. 1 is a schematic process diagram of a suitable tissue manufacturing process, illustrating the production of a parent roll.

FIG. 1 is a schematic illustration of a suitable process for making parent rolls in accordance of this invention as illustrated in U.S. Pat. No. 5,672,248 to Wendt et al., which is hereby incorporated by reference. While any tissue making process can be used to make parent rolls in accordance with this invention, throughdrying processes are particularly suitable because they produce relatively high bulk tissue sheets that can benefit from purposely induced variations in sheet moisture and sheet caliper, for example. Shown is a twin wire former having a layered papermaking headbox 10 which injects or deposits a stream 11 of an aqueous suspension of papermaking fibers onto the forming fabric 12. The web is then transferred to fabric 13, which serves to support and carry the newly-formed wet web downstream in the process as the web is partially dewatered to a consistency of about 10 dry weight percent. Additional dewatering of the wet web can be carried out, such as by vacuum suction, while the wet web is supported by the forming fabric.

The wet web is then transferred from the forming fabric to a transfer fabric 17 traveling at a slower speed than the forming fabric in order to impart increased MD stretch into the web. A kiss transfer is carried out to avoid compression of the wet web, preferably with the assistance of a vacuum shoe 18. The transfer fabric can be a fabric having impression knuckles as described in U.S. Pat. No. 5,672,248 to Wendt et al. or it can be a smoother fabric such as Asten 934, 937, 939, 959 or Albany 94M. If the transfer fabric is of the impression knuckle type, it can be utilized to impart some of the same properties as the throughdrying fabric and can enhance the effect when coupled with a throughdrying fabric also having the impression knuckles. When a transfer fabric having impression knuckles is used to achieve the desired CD stretch properties, it provides the flexibility to optionally use a different throughdrying fabric, such as one that has a decorative weave pattern, to provide additional desirable properties not otherwise attainable.

The web is then transferred from the transfer fabric to the throughdrying fabric 19 with the aid of a vacuum transfer roll 20 or a vacuum transfer shoe. The throughdrying fabric 30 can be traveling at about the same speed or a different speed relative to the transfer fabric. If desired, the throughdrying fabric can be run at a slower speed to further enhance MD stretch. Transfer is preferably carried out with vacuum assistance to ensure deformation of the sheet to conform to the throughdrying fabric, thus yielding desired bulk, flexibility, CD stretch and appearance.

The level of vacuum used for the web transfers can be from about 3 to about 15 inches of mercury (75 to about 380 millimeters of mercury), preferably about 10 inches (254 millimeters) of mercury. The vacuum shoe (negative pressure) can be supplemented or replaced by the use of positive pressure from the opposite side of the web to blow the web onto the next fabric in addition to or as a replacement for sucking it onto the next fabric with vacuum. Also, a vacuum roll or rolls can be used to replace the vacuum shoe(s).

While supported by the throughdrying fabric, the web is final dried to a consistency of about 94 percent or greater by the throughdryer 21 and thereafter transferred to a carrier fabric 22. The dried basesheet 23 is transported to the reel 24 using carrier fabric 22 and an optional carrier fabric 25 and wound into a parent roll 27. An optional pressurized turning roll 26 can be used to facilitate transfer of the web from carrier fabric 22 to fabric 25. Suitable carrier fabrics for this purpose are Albany International 84M or 94M and Asten 959 or 937, all of which are relatively smooth fabrics having a fine pattern. Although not shown, reel calendering or subsequent off-line calendering can be used to improve the smoothness and softness of the basesheet.

Figure 2:
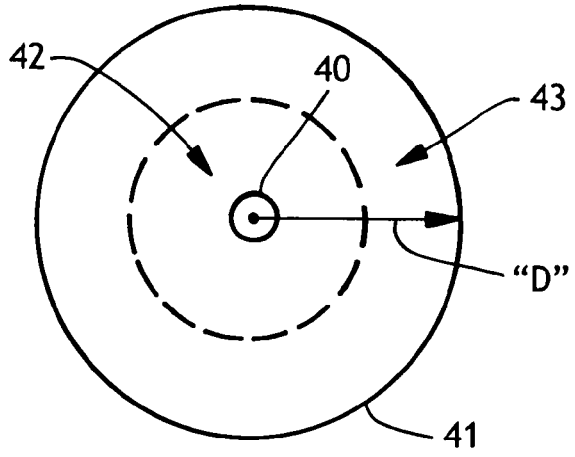
FIG. 2 is a cross-section of a parent roll, illustrating the core region and the outer region.

FIG. 2 is a schematic illustration of a cross section of a parent roll. Shown is the core 40 around which the sheet is wound and the outer surface 41. The diameter of the parent roll is represented by the arrow "D", with the center of the core being the point where the diameter of the parent roll is zero. Since the diameter of the core is about 20 inches for commercial parent rolls, not all of the parent roll diameter is occupied by the wound tissue sheet. The region of the parent roll within the dashed line, designated by reference number 42 is referred to herein as the "core region" of the parent roll. The region outside the dashed line, designated by reference number 43, is referred to herein as the "outer region" of the parent roll. The inner region corresponds to the first 50 percent of the parent roll diameter and the outer region corresponds to the remaining 50 percent of the diameter.

Figure 3:
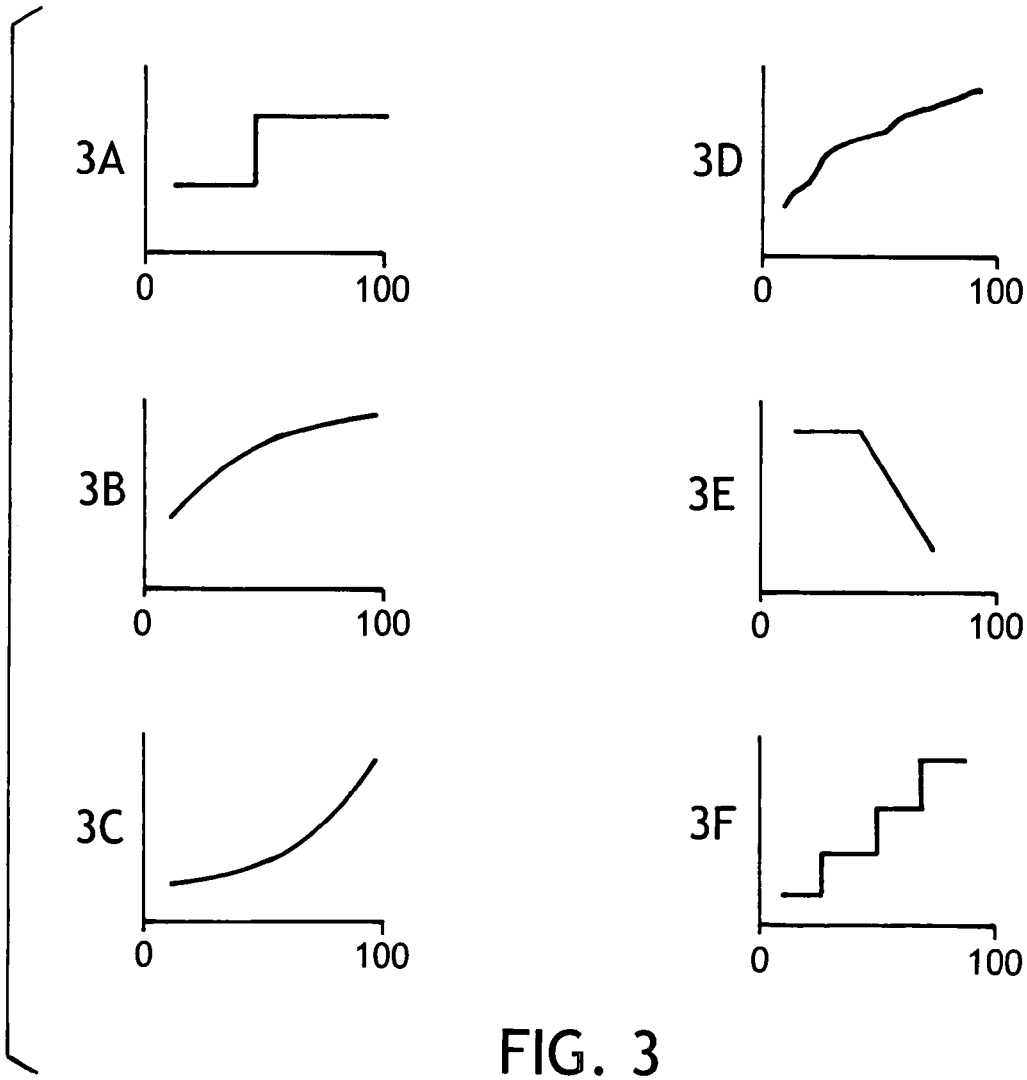
FIG. 3 is a series of schematic illustrations of intrinsic property gradients, shown as a function of parent roll diameter position, in accordance with this invention.

FIG. 3 is a series of schematic illustrations of intrinsic property gradients in accordance with this invention. Each illustration represents a plot of the intrinsic sheet property value as a function of parent roll diameter position, expressed as a percentage of the parent roll diameter. The purpose of these figures is to show that the shape of the gradient can take many forms, depending upon the intrinsic property involved and the precision with which the manufacturing operation can be changed to influence the gradient. For example, FIG. 3A shows an idealized step change gradient. FIG. 3B shows a gradually increasing gradient. FIG. 3C shows another gradually increasing gradient. FIG. 3D shows a generally increasing, but irregular, gradient. FIG. 3E shows a linearly decreasing gradient. FIG. 3F shows a gradient with a series of step changes. For all of these gradients, the direction of the gradient can be reversed, depending upon the desired result. In all cases, the gradient represents changes of the intrinsic sheet property as a function of parent roll diameter position that deviate significantly from variations due to ordinary manufacturing operations.

Figure 4:
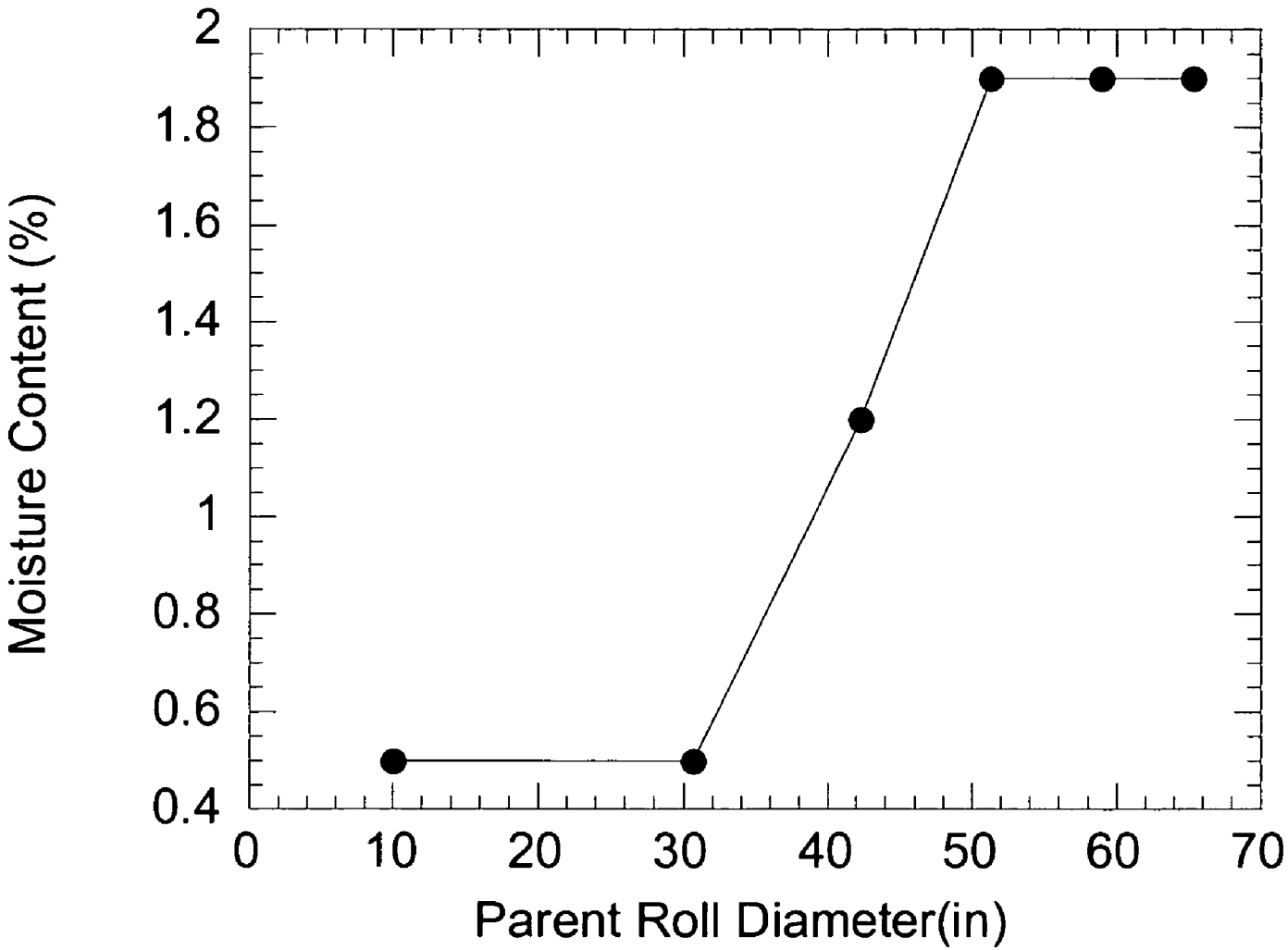
FIG. 4 is a plot of the measured moisture content on a small parent roll with moisture transitioning from low to high (from about 0.5 to about 2 percent) at approximately 40 inches in diameter as described in Example 3.

FIG. 4 is a plot of the measured moisture content versus diameter for a small parent roll made on an experimental tissue machine by having full vacuum and drying at the beginning of the roll (diameter of 10") and then decreasing the vacuum starting at a diameter of about 30 inches. The result is a low moisture content of about 0.5 percent in the core region and a higher moisture content in the outer region of about 2 percent.

Figure 5:
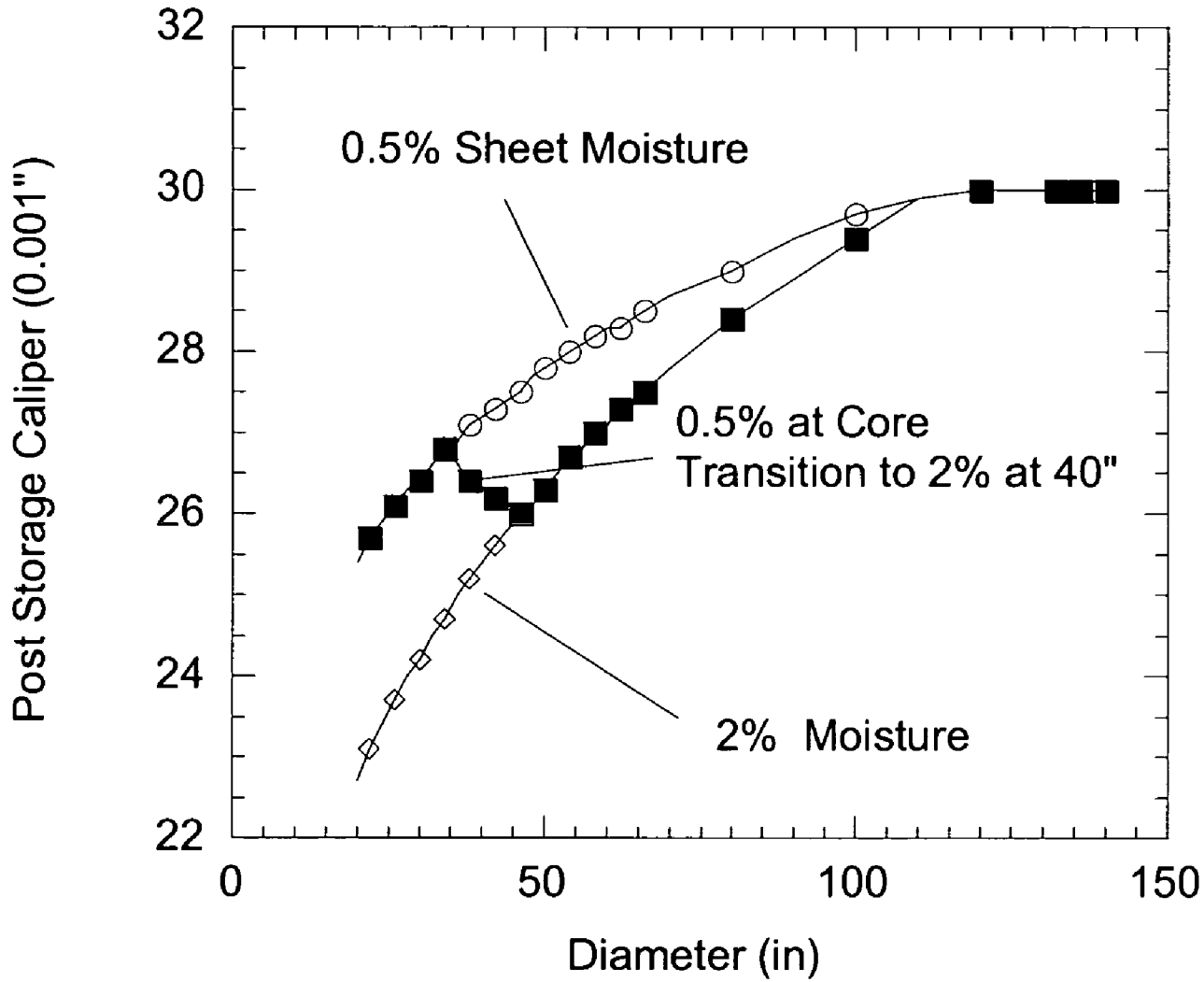
FIG. 5 is a plot of predicted post-storage parent roll sheet caliper as a function of parent roll diameter position for constant sheet moisture values of 0.5 percent and 2 percent and, for comparison, a sheet moisture value transitioning from 0.5 to 2 percent (this invention).

FIG. 5 is a plot of predicted post-storage parent roll sheet caliper as a function of parent roll diameter position for various sheet moisture values for a full-sized 140 inches diameter parent roll. As shown, the sheet caliper is relatively low in the core region and gradually increases until about the middle of the roll, at which point it flattens out for the balance of the roll, including the outer region of the roll. (The caliper at the larger diameters is relatively unaffected by moisture content because the sheet in this area is under a low pressure. When the pressure is sufficiently low, there is very little caliper loss regardless of moisture content.)

As shown, the sheet caliper in the core region of the parent roll is lower for the 2 percent moisture sheet than for the 0.5 percent moisture sheet. For the parent roll having a sheet moisture content of about 0.5 percent in the core region and about 2 percent in the outer region (this invention), the uniformity of the sheet caliper is improved as compared to the sheet having 2 percent moisture, and is about the same as that for the 0.5 percent moisture sheet, even though the majority of the roll is at the higher moisture content. The ultimate benefit of the invention with regard to the final tissue product is illustrated in FIGS. 7 and 8.

Figure 6:
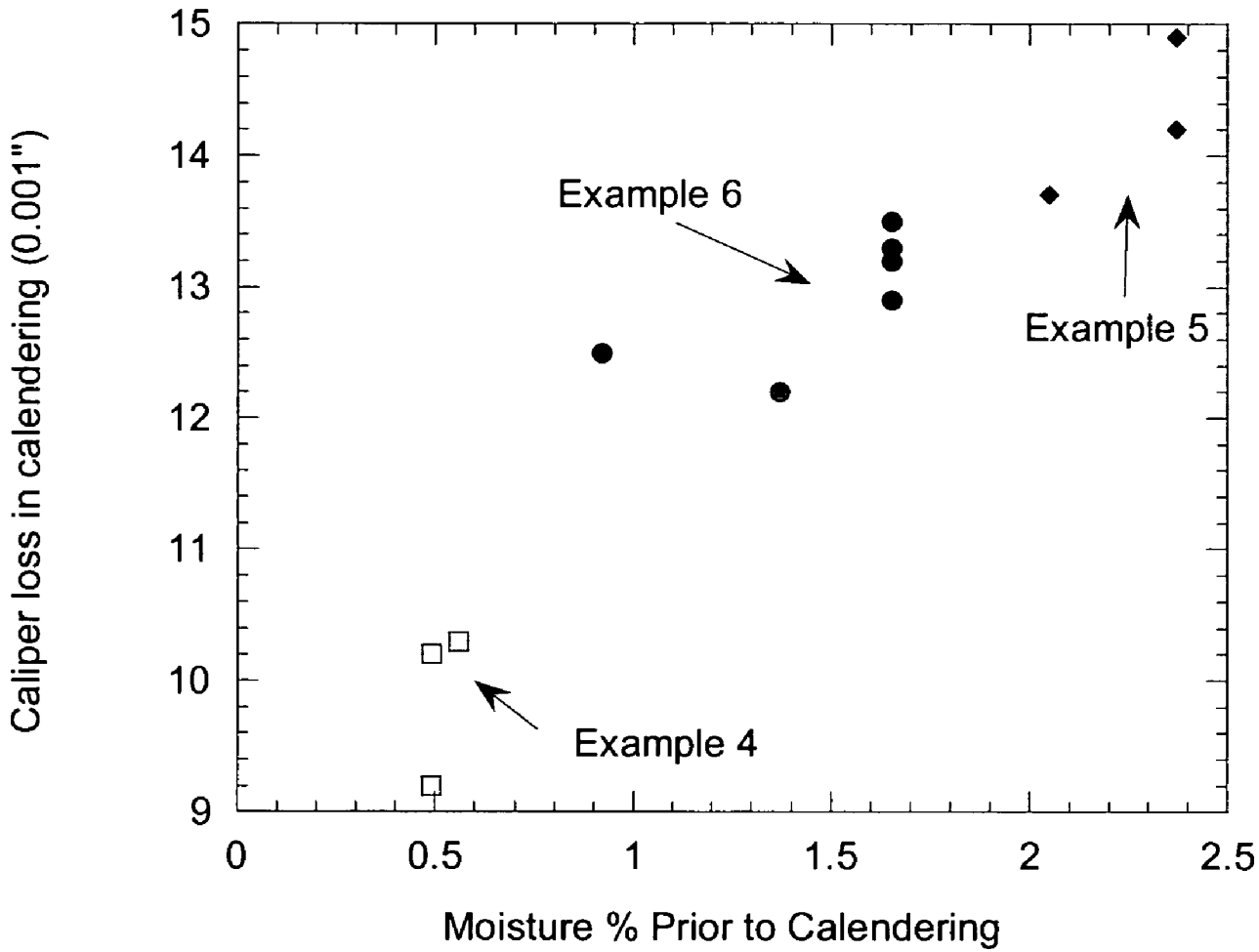
FIG. 6 is a plot of the caliper loss as a function of moisture content for the calendered basesheet of Examples 4-6.

FIG. 6 is a plot of the caliper loss content during calendering as a function of moisture content for tissue basesheets made in accordance with Examples 4-6. This information concerning caliper lost in calendaring combined with the post-storage caliper of FIG. 5 is used to generate FIG. 7.

Figure 7:
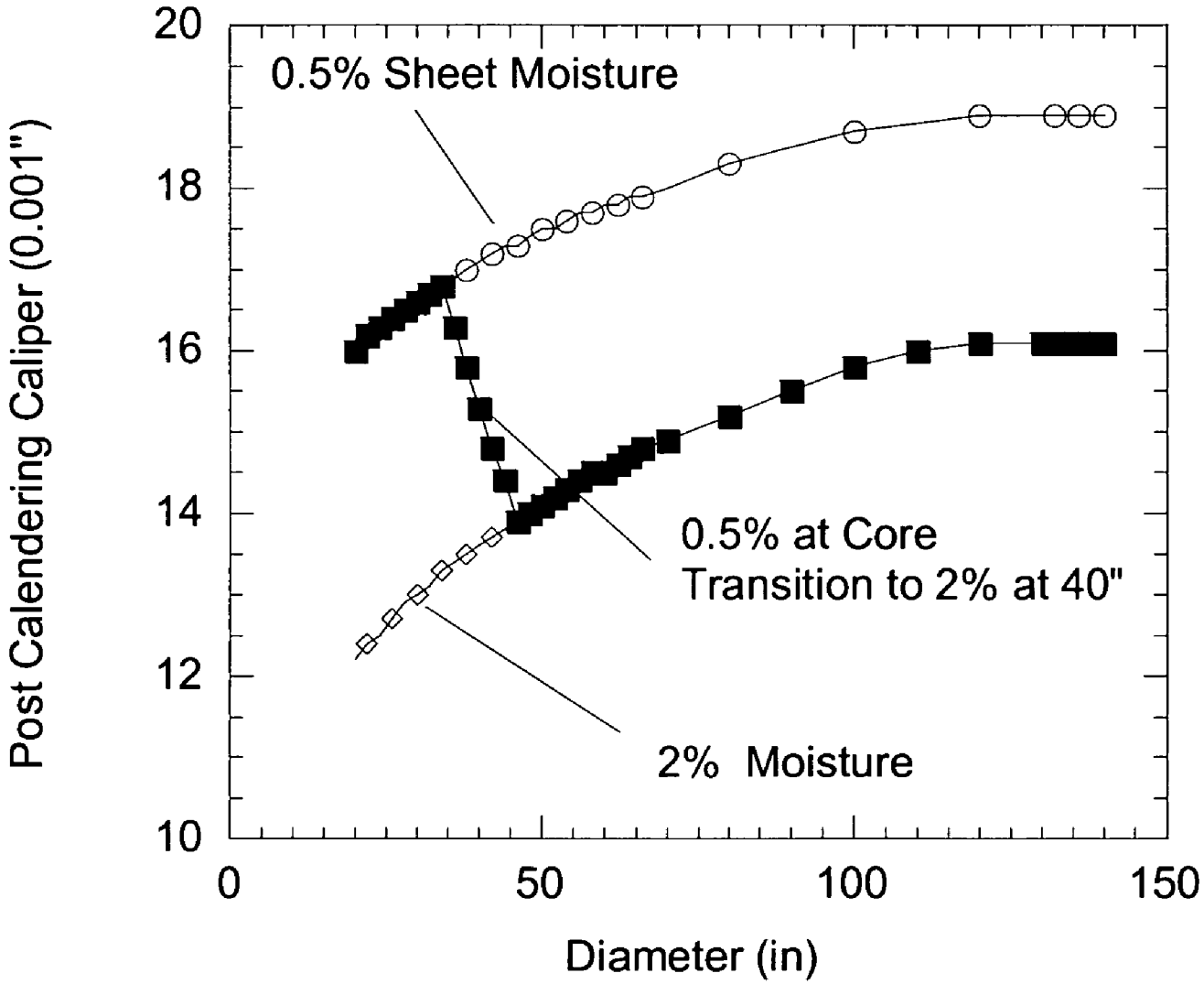
FIG. 7 is a plot of predicted post-calendering caliper, using a calendering pressure of 45 pounds per linear inch (pli), for the basesheets described in FIG. 5.

FIG. 7 is a plot of the predicted post-calendering sheet caliper as a function of parent roll diameter position for a full sized 140" diameter parent roll. As shown, the post-calendering caliper for the 0.5 percent moisture basesheet and the 2 percent moisture basesheet is lower for portions of the sheet coming from the core region of the parent roll and rises to a steady value for portions of the sheet coming from the outer region of the parent rolls. As expected, the overall sheet caliper for the sheet derived from the 0.5 percent moisture parent roll is higher than the sheet caliper derived from the 2 percent moisture parent roll due to their greater compressive resistance by having less moisture. However, the sheets made in accordance with this invention, which derived from a parent roll having about 0.5 percent moisture in the core region and 2 percent moisture in the outer region of the parent roll, produced a post-calendering caliper which is more uniform regardless of parent roll sheet position. The low moisture 0.5 percent sheet in the core region resists calendering compression much better than the 2 percent moisture sheet in the outer region. As a result, the sheet in the core region loses less caliper than the sheet in the outer region and the caliper profile evident after storage is minimized.

Figure 8:
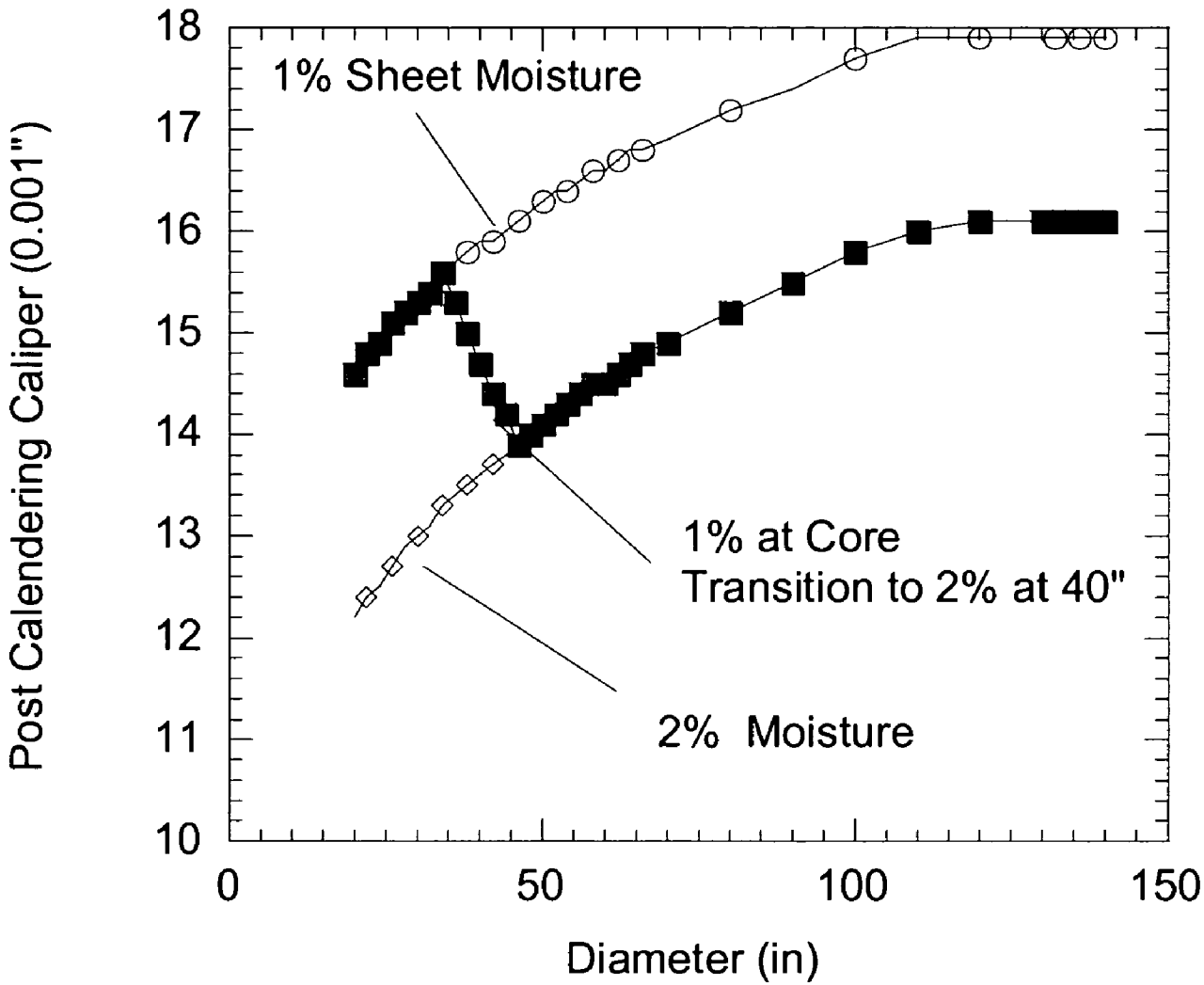
FIG. 8 is a plot of predicted post-calendering sheet caliper as a function of parent roll diameter position for constant sheet moisture values of 1 percent and 2 percent and, for comparison, a sheet moisture value transitioning from 1 to 2 percent (this invention).

FIG. 8 is a plot, similar to that of FIG. 6, but comparing the post-calendering caliper for basesheets having a constant moisture content of 1 percent or 2 percent, with a sheet in which the moisture content transitions from 1 percent to 2 percent in accordance with this invention. As shown in FIG. 6, the post-calendering caliper profile for the basesheet of this invention is more uniform.

EXAMPLES

Example 1 (Comparative)

Parent Roll with 0.5 Percent Moisture

A throughdried tissue web was produced generally as described in FIG. 1. The throughdrying fabric speed was approximately 1500 feet per minute and approximately 25 percent rush transfer was utilized to transfer the web from the transfer fabric to the throughdrying fabric. The transfer fabric was a t807-1 (Voith Fabrics) and the throughdrying fabric was a t1207-12 (Voith Fabrics). The furnish was approximately ⅓ northern softwood kraft (NSWK) pulp and ⅔ eucalyptus. The resulting basesheet had a bone dry basis weight of approximately 30 grams per square meter (gsm).

Water was removed from the tissue web using three vacuum dewatering boxes. Each vacuum box was attached to a Nash vacuum pump and the vacuum levels set to achieve approximately 30 percent consistency in the web after the vacuum dewatering unit operation.

Drying was carried out using two throughdryers in series. Final sheet moisture was controlled to 0.5 percent throughout the entire parent roll by controlling the throughdrying gas and air flow rates per standard throughdrying procedures. These parameters were adjusted until a sheet moisture of approximately 0.5 percent was achieved uniformly throughout the parent roll.

The dried basesheet was wound into a parent roll having a diameter of about 70 inches with a relatively low in-wound pressure (due to its smaller size). This low pressure parent roll does not cause significant caliper loss due to creep. However, measurements of the creep rate as a function of pressure and moisture content allow an accurate prediction of the caliper profile as a function of time for a full-sized, full-pressure commercial parent roll. Parent roll moisture was first determined with a moisture probe that measured humidity in the air between the plies of the wound roll and then confirmed by taking web samples which were dried overnight in an oven at 105° C.

Example 2 (Comparative)

Parent Roll with 2 Percent Moisture

Parent rolls were produced as described in Example 1, except one of the three vacuum pumps was turned off to reduce the level of dewatering of the wet web, resulting in a parent roll having a sheet moisture of 2 percent.

Example 3 (Invention)

Parent Roll with 0.5-2 Percent Moisture Gradient

The processes of Examples 1 and 2 were combined to produce a parent roll with a 0.5-2 percent moisture gradient. Specifically, the production of roughly the first half of the parent roll was done according to Example 1 with all vacuum boxes active. This yielded a parent roll with a 0.5 percent sheet moisture content in the core region. When the parent roll reached a diameter of roughly 30 inches, one vacuum pump was turned off in accordance with Example 2. As the reduction in dewatering vacuum was instantaneous, a relatively sharp step-wise moisture transition was achieved. At this point the dried sheet moisture increased to 2 percent and the remainder of the parent roll (70 inches in diameter) was built using this operating condition. In this manner, a parent roll with a sheet moisture of about 0.5 percent in the core region and about 2 percent moisture in the outer region of the parent roll was produced. The results are illustrated in FIG. 4.

For commercial parent rolls, the rate of caliper loss for basesheets made in accordance with Examples 1-3 was estimated by compressing a stack of sheets between two plates under a controlled relative humidity and measuring the caliper loss as function of time and applied load. It was determined that caliper loss due to creep is described well by the expression:

$$C_c = C_0\left(\frac{C_a}{C_0}\right)^{\alpha \ln(t)} \tag{1}$$

where "α" is the creep rate, "$C_0$" is the sheet caliper under 2 kPa, "$C_c$" is the sheet caliper after creeping for t seconds under the applied load which squeezes the sheet down to the applied caliper of "$C_a$". The creep rate for tissue sheets was found to increase with the moisture content of the sheet as:

$$\alpha = 0.025 + 1.5m \tag{2}$$

where "m" is the moisture of the sheet in grams of water per gram of fiber (g/g).

The in-wound caliper profile of a typical, tightly wound 140 inches diameter parent roll made from the basesheet described in Examples 1-3 can be described by the expression:

$$C_a = 9.86D^{0.24} \tag{3}$$

where $C_a$ is the in-wound caliper and "D" is the parent roll diameter.

Equations (1) and (2) were used along with the typical in-wound caliper profile described in Equation (3) to predict the final caliper that would result for the sheets of Examples 1-3 after storage in a typical 140 inches diameter parent roll after storage for 72 hours. The results of this are prediction are shown in FIG. 5.

Examples 4-6

Calendering Sheets from Examples 1-3

The parent rolls from Examples 1-3 were wrapped in plastic to minimize uptake of moisture from the environment and stored for 7 days. After storage, the moisture content was measured using the equilibrium relative humidity probe. The rolls were then calendered between a steel roll and a relatively soft (40 P&J Hardness) rubber-coated roll at a rate of about 400 feet per minute. The rolls were pressed together with a 45 pounds per lineal inch loading. The calendered sheet was then rewound into approximately 4.5 inches diameter finished product bath tissue rolls. The caliper of the sheets in the finished product rolls was measured immediately after production. The loss in caliper during calendering is set forth in FIG. 6 and correlated well with the post-storage moisture content of the sheet and is described well by the expression:

$$C_f = C_c\left(\frac{2.6}{PLI}\right)^{0.14+3.7m} \tag{4}$$

where "$C_f$" is the final caliper in 0.001 inch units, "$C_c$" is the caliper after storage, "PLI" is the caliper load (45 pli for this example) in pounds per linear inch and "m" is the moisture content in g/g.

Equations (1)-(4) for the sheets made in Examples 1-6 can be combined to predict the finished product caliper after storage and rubber-steel nip calendering at 45 pli as:

$$C_f = C_0\left(\frac{C_a}{C_0}\right)^{(0.025+1.5m)\ln(t)}\left(\frac{2.6}{PLI}\right)^{0.14+3.7m} \tag{5}$$

Equation (5) was used to predict the caliper profile after storage and calendering for basesheets from 140 inches diameter parent rolls with moisture profiles as described in Examples 4-6, with the results plotted in FIG. 7.

It will be appreciated that the foregoing examples, given for purposes of illustration, are not to be construed as limiting the scope of this invention, which is defined by the following claims and all equivalents thereto.

We claim:

1. A parent roll comprising a tissue web having a machine direction moisture profile wound around a core thereby forming a core area and an outer area wherein the average sheet moisture in the core region is from about 0.5 to about 1.5 weight percent and the average sheet moisture in the outer region is from about 2 to about 4 weight percent, wherein the average sheet moisture is measured upon formation of the parent roll.

2. The parent roll of claim 1 wherein the average sheet moisture in the core region is from about 0.5 to about 1 weight percent and the average sheet moisture in the outer region is from about 2 to about 3 weight percent.

3. The parent roll of claim 1 wherein the sheet caliper in the core region is equal to or greater than the sheet caliper in the outer region.

4. A parent roll having a z-directional moisture gradient, the parent roll comprising a tissue web having a machine direction moisture profile wound around a core thereby forming a core region spanning from about 0 to about 30 inches from the core, a transitional region spanning from about 30 to about 50 inches from the core and an outer region spanning from about 50 to about 150 inches from the core, wherein the average sheet moisture in the core region is from about 0.5 to about 1.5 weight percent and the average sheet moisture in the outer region is from about 2 to about 4 weight percent, wherein the average sheet moisture is measured upon formation of the parent roll.

5. The parent roll of claim 4 wherein the average sheet moisture in the core region is from about 0.5 to about 1 weight percent and the average sheet moisture in the outer region is from about 2 to about 3 weight percent.

* * * * *